United States Patent [19]

Krogsrud

[11] 3,975,576

[45] Aug. 17, 1976

[54] ROTATABLE FURNACE POT INCLUDING STOKING MEANS

[75] Inventor: Harald Krogsrud, Gjettum, Norway

[73] Assignee: Elkem-Spigerverket A/S, Oslo, Norway

[22] Filed: Apr. 23, 1975

[21] Appl. No.: 570,800

[30] Foreign Application Priority Data

Apr. 25, 1974 Norway ..... 1501/74

[52] U.S. Cl. ..... 13/10; 13/33

[51] Int. Cl.[2] ..... F27D 3/00

[58] Field of Search ..... 13/9, 10, 33, 34

[56] References Cited

UNITED STATES PATENTS

| | | | |
|---|---|---|---|
| 2,744,944 | 5/1956 | Striplin, Jr. et al. | 13/10 |
| 3,679,806 | 7/1972 | Reth et al. | 13/9 |

*Primary Examiner*—R. N. Envall, Jr.

*Attorney, Agent, or Firm*—Eyre, Mann, Lucas & Just

[57] ABSTRACT

A rotatable furnace pot including stoking apparatus is disclosed. The stoking apparatus is disposed within the side wall of the pot whereby the charge can be moved inward and upward in the furnace pot rather than compressed.

18 Claims, 2 Drawing Figures

ROTATABLE FURNACE POT INCLUDING STOKING MEANS

The present invention is related to my copending application Ser. No. 570,799 filed Apr. 23, 1975, entitled IMPROVED ROTATABLE FURNACE POT FOR SMELTING FURNACES.

In the copending application there is disclosed a rotatable furnace pot which is segmented into upper and lower sections whereby substantial advantage is obtained as therein described.

Even where a furnace pot is made rotatable to reduce crusts, hangings and the like and effect more even heating of the charge, it is still usually desirable to associate with the rotatable furnace pot stoking means for moving the charge. These stoking means are usually apparatus which operate from the floor around the furnace pot either in stationary position or from movable stoking cars. The stoking apparatus extends over the rim of the pot and into the pot to effect movement of the charge from the top. The disadvantages to such stoking arrangements are that they cannot be used with covered furnaces and that the stoking is effected downwards in the furnace pot. The effect of the latter is that while the charge is moved, it is also compressed which reduces the effectiveness of the stoking apparatus. A further problem is that the stoking apparatus is usually not effective along the furnace circumference such that crusts and bridges form thus reducing the effective diameter of the furnace pot, a most undesirable and uneconomic result. It is also pointed out that these stoking apparatuses are undesirable from a personnel point of view in that the stoking takes place in a very warm and dust laden atmosphere.

In connection with the apparatus as disclosed in my copending application referred to hereinbefore wherein the rotatable furnace pot is composed of upper and lower segments, I have discovered that where the upper segment is maintained stationary, considerable advantage can be obtained by disposing the stroking member through the side wall of the upper segment of the furnace pot. The stoking apparatus is disposed through the side wall of the upper segment of the furnace pot below the level of the charge and is operable to move the charge in an inwards and upwards direction.

Figure 1:
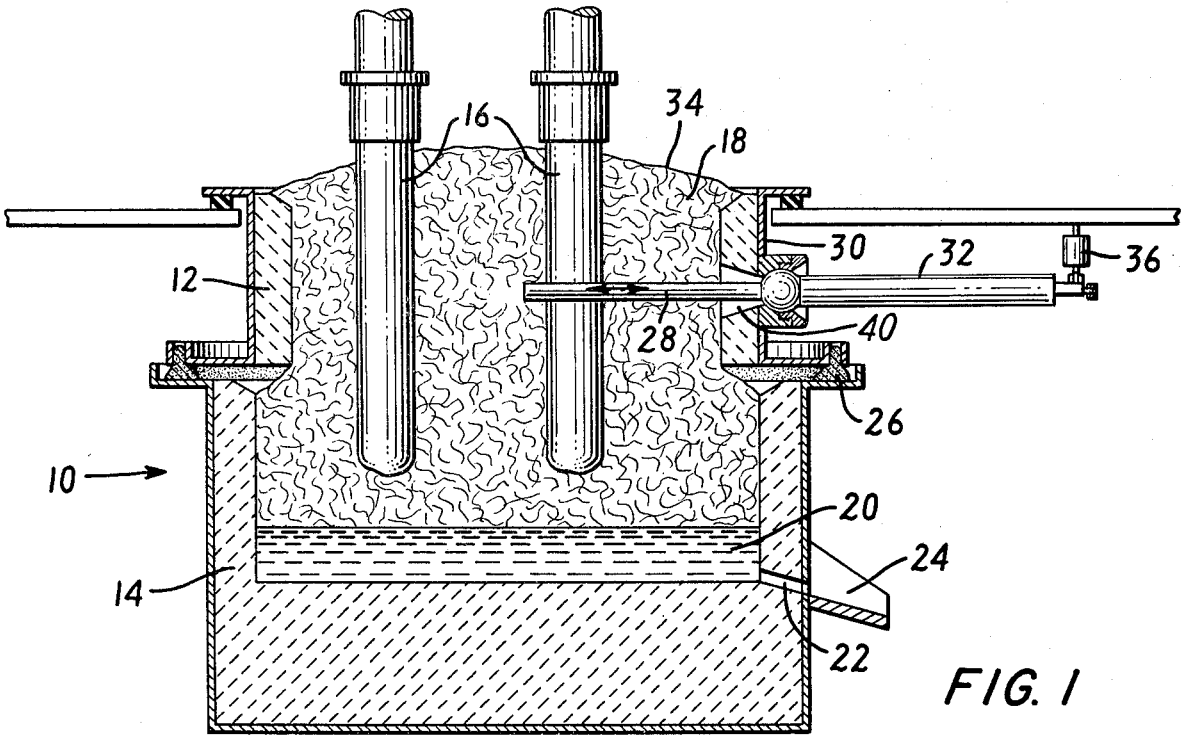
Figure 2:
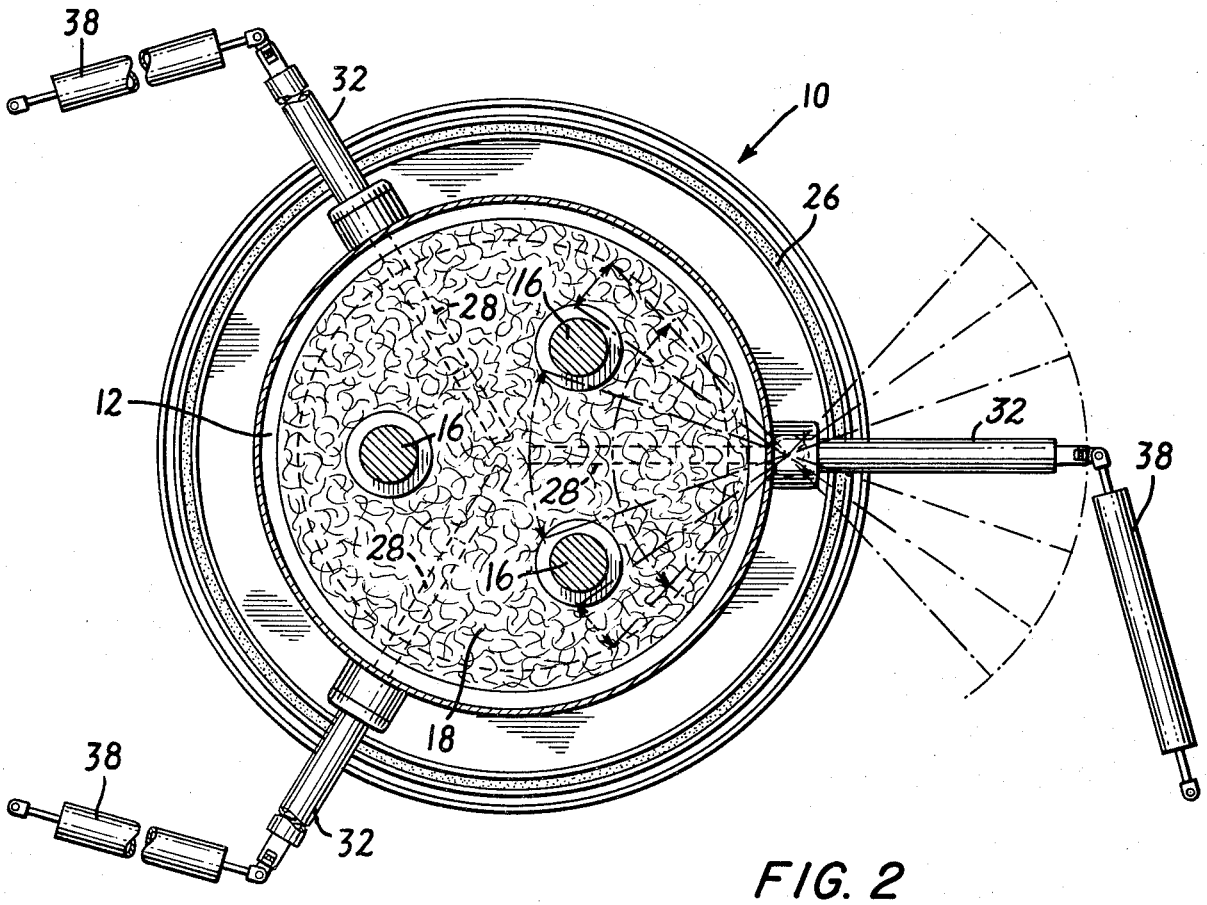

These and other features of the present invention may be more fully understood with reference to the drawings in which:

FIG. 1 is a section of a side view of the apparatus of the present invention; and FIG. 2 is a top section view of the apparatus of the present invention.

In FIG. 1 there is shown a furnace pot 10 divided into upper segment 12 and lower segment 14. As described in my copending application, each of these segments should be at least 25% of the height of the furnace pot. Electrodes 16 in the furnace pot are surrounded by dry charge 18 which is reduced to molten slag 20 which can be removed through tapping hole 22 by means of spout 24. The top segment 12 in accordance with the present invention is made non-rotatable while the bottom segment 14 is rotatable. A gaslight seal such as sand 26 is employed between the upper and lower segments to maintain a good heating arrangement.

A stoking member 28 passes through the side wall 30 of the stationary upper segment 12 and is affixed to stoking arm 32. The stoking arm is movable to effect movement of stoking member 28 within the furnace pot. It will be noted that stoking member 28 is positioned in side wall 30 of the upper segment 12 below the top 34 of the charge 18 whereby movement of the charge can be effected in an inwards and upwards direction including the area at the circumference of the furnace pot. Movement of the stoking arm is preferably in both horizontal and vertical directions, suitably by hydraulic cylinder 36 in the vertical direction and the hydraulic cylinder 38 (FIG. 2) in the horizontal direction. While the stoking member 28 is shown pivoted at the furnace wall 30, it will be appreciated that it could be equally well pivoted inside or outside of the upper segment 12 provided a suitable sealing means is associated with the opening 40 of the wall of the upper segment 12.

Any number of stoking members can be used as desired but it has been found suitable to employ three stoking members displaced approximately 120° from each other about the circumference of the upper segment 12 and as shown in FIG. 2. As also shown in FIG. 2, the stoking members are preferably spaced equidistant between the equilateral triangularly arranged electrodes 16.

While hydraulic cylinders have been shown for movement of the stoking arms, it will be appreciated that this could also be effected by other means such as pneumatic cylinders, electric motors with associated cams or systems of cranks or the like.

It will be understood that the claims are intended to cover all changes and modifications of the preferred embodiment of the invention, herein chosen for the purpose of illustration, which do not constitute departures from the spirit and scope of the invention.

What is claimed is:

1. In a smelting furnace, a smelting pot, said smelting pot being divided into upper and lower wall segments each of which is at least 25% of the height of the electric smelting pot, the upper wall segment being stationary and the lower wall segment being rotatable, at least one stoking member which passes through an opening in the wall of the upper stationary wall segment at a height below a maximum height to which said upper wall segment is operative to enclose charge and means for effecting movement of said stoking member.

2. The apparatus of claim 1 wherein there are three stoking members.

3. The apparatus of claim 2 wherein the stoking members are displaced approximately 120° from each other about the circumference of the furnace pot.

4. The apparatus of claim 3 further including three electrodes arranged in an equilateral triangle in the center of the smelting pot, each stoking member being positioned approximately equidistant between two of the electrodes.

5. The apparatus of claim 1 wherein the means for movement of the stoking member effects both vertical and horizontal displacement thereof.

6. In a smelting furnace, a smelting pot, said smelting pot being divided into upper and lower wall segments each of which is at least 25% of the height of the electric smelting pot, the upper wall segment being stationary and the lower wall segment being rotatable, at least one stoking member which passes through an opening in the wall of the upper stationary wall segment at a height below a maximum height to which said upper wall segment is operative to enclose charge and means for effecting movement of said stoking member, said stoking member being operative to be moved by said means at least substantially along the periphery of at least a portion of said upper wall segment.

7. The apparatus of claim 6, wherein there are three stoking members.

8. The apparatus of claim 7, wherein the stoking members are displaced approximately 120° from each other about the circumference of the furnace pot.

9. The apparatus of claim 8 further including three electrodes arranged in an equilateral triangle in the center of the smelting pot, each stoking member being positioned approximately equidistant between two of the electrodes.

10. The apparatus of claim 6, wherein the means for movement of the stoking member effects both vertical and horizontal displacement thereof.

11. In a smelting furnace, a smelting pot, said smelting pot being divided into upper and lower wall segments each of which is at least 25% of the height of the electric smelting pot, the upper wall segment being stationary and the lower wall segment being rotatable, at least one stoking member which passes through an opening in the wall of the upper stationary wall segment at a height below a maximum height to which said upper wall segment is operative to enclose charge and means for effecting movement of said stoking member, said stoking member being operative to be moved by said means in both vertical and horizontal directions and at least substantially along the periphery of at least a portion of said upper wall segment.

12. The apparatus of claim 11 wherein there are three stoking members.

13. The apparatus of claim 12, wherein the stoking members are displaced approximately 120° from each other about the circumference of the furnace pot.

14. The apparatus of claim 13 further including three electrodes arranged in an equilateral triangle in the center of the smelting pot, each stoking member being positioned approximately equidistant between two of the electrodes.

15. In a smelting furnace, a smelting pot, said smelting pot being divided into upper and lower wall segments each of which is at least 25% of the height of the electric smelting pot, the upper wall segment being stationary and the lower wall segment being rotatable, at least one stoking member which passes through an opening in the wall of the upper stationary wall segment at a height below a maximum height to which said upper wall segment is operative to enclose charge and means for effecting movement of said stoking member, said means comprising a stoking arm to which said stoking member is pivotably connected, said stoking arm being positioned at the exterior of said upper wall segment and operative to move said stoking member in both vertical and horizontal directions and at least substantially along the periphery of at least a portion of said upper wall segment.

16. The apparatus of claim 15, wherein there are three stoking members.

17. The apparatus of claim 16, wherein the stoking members are displaced approximately 120° from each other about the circumference of the furnace pot.

18. The apparatus of claim 17 further including three electrodes arranged in an equilateral triangle in the center of the smelting pot, each stoking member being positioned approximately equidistant between two of the electrodes.

* * * * *